US008253641B1

(12) United States Patent
Waterman

(10) Patent No.: US 8,253,641 B1
(45) Date of Patent: Aug. 28, 2012

(54) WIDEBAND WIDE SCAN ANTENNA MATCHING STRUCTURE USING ELECTRICALLY FLOATING PLATES

(75) Inventor: Timothy G. Waterman, Eldersburg, MD (US)

(73) Assignee: Northrop Grumman Systems Corporation, Los Angeles, CA (US)

( * ) Notice: Subject to any disclaimer, the term of this patent is extended or adjusted under 35 U.S.C. 154(b) by 314 days.

(21) Appl. No.: 12/829,672

(22) Filed: Jul. 2, 2010

Related U.S. Application Data

(60) Provisional application No. 61/223,956, filed on Jul. 8, 2009.

(51) Int. Cl.
*H01Q 13/00* (2006.01)

(52) U.S. Cl. ..... 343/772

(58) Field of Classification Search ..... 343/772, 343/754, 767, 837–840, 862–863
See application file for complete search history.

(56) References Cited

U.S. PATENT DOCUMENTS 4,814,778 A 3/1989 Roederer et al.
5,365,244 A 11/1994 Yon et al.
5,459,475 A * 10/1995 Shen et al. ..... 343/781 P
5,828,345 A * 10/1998 Waterman et al. ..... 343/770
6,577,282 B1 * 6/2003 Rao et al. ..... 343/781 CA
7,126,195 B1 * 10/2006 Sandhu et al. ..... 257/382
7,126,495 B2 * 10/2006 Netzer ..... 340/870.39
7,227,495 B2 * 6/2007 Bletz et al. ..... 342/124
2005/0151694 A1 7/2005 Huang

OTHER PUBLICATIONS

Marjan Mokhtaari, Jens Bornemann, Smain Amari, Quasi-elliptic dual-band filter design using stepped-impedance resonators and coupling topologies for narrow-to-wide-band applications, IET Microw. Antennas Propag., 2008, vol. 2, No. 8, pp. 863-870.

Dimitrios E. Anagnostou, Symeon Nikolaou, Hyungrak Kim, Boyon Kim, Manos Tentzeris, and John Papapolymerou, Dual Band-Notched Ultra-Wideband Antenna for 802.11a WLAN Environments, IEEE, 2007, pp. 4621-4624.

* cited by examiner

*Primary Examiner* — Huedung Mancuso
(74) *Attorney, Agent, or Firm* — Marstellar & Associates, P.C.

(57) ABSTRACT

A radiator (A) has a receiver segment (22) and an adjacent transformer segment (24). The receiver (22) has a first (26) and an opposite second face (28). The second face (28) includes a generator (30) of a signal (20) that propagates from the receiver segment (22). A first face (32) of the transformer segment (24) is formed adjacent to the receiver segment second face (28). A transmitted signal (20) propagates through the transformer segment (24) from the first (32) to a second face (34). A plurality of free floating plates (38) are formed within the transformer segment (24) in layers (40) with gaps (42) permitting signal (20) passage. The floating plates (38) deflect the signal path through the transformer segment (24).

14 Claims, 6 Drawing Sheets

WIDEBAND WIDE SCAN ANTENNA MATCHING STRUCTURE USING ELECTRICALLY FLOATING PLATES

CROSS REFERENCE TO RELATED APPLICATIONS

This application claims the benefit of U.S. Provisional Application Ser. No. 61/223,956, filed Jul. 8, 2009, entitled WIDEBAND WIDE SCAN ANTENNA MATCHING STRUCTURE USING ELECTRICALLY FLOATING PLATES.

BACKGROUND OF THE INVENTION

1. Technical Field

The invention relates to the field of antennas that propagate an electronic signal, and more particularly to a planar array type of antenna comprising a plurality of signal generating or receiving elements having a transceiver segment substrate with a dielectric substrate formed on top of a signal generating face of the driver segment substrate.

2. Background Art

There are many alternative forms and formats for an antenna that propagates an electronic signal. An antenna often is designed or adapted particularly for a selected frequency range, size, or directional characteristics.

The current state of the art for one wideband antenna design consists of antenna having a substrate layer having a plurality of driver segments generating the electronic signal. A machined/molded stepped transformer layer is made from metal or plated plastic and is formed on a face of the substrate layer to change the electrical impedance characteristics of the antenna for optimal signal matching or transmission and other reasons. Such an antenna design tends to be long or thick to achieve the required bandwidth. They are usually attached to an antenna array at or near the feed points. They are complicated and expensive elements by themselves, and are difficult to attach to the feed points because electrical contact needs to be maintained.

A traditional notch element can realize very wide bandwidths by employing an impedance taper, such as a Chebyshev or Exponential, to match the impedance at the feed to that of free space. In the stepped notch, the width and length of each stepped section is adjusted to provide the individual impedance values required to realize the desired taper. The total number of sections (and overall height) is dependent upon the amount of bandwidth required. See, FIGS. 3 and 5

While the above cited references introduce and disclose a number of noteworthy advances and technological improvements within the art, none completely fulfills the specific objectives achieved by this invention.

DISCLOSURE OF INVENTION

In accordance with the present invention, a radiator or planar antenna array for conveying an electronic signal of the type including a transceiver segment or substrate and an adjacent transformer to free space segment or layer. The receiver or driver segment generally has a first face and an opposite second face. The second face further includes at least one source or location for generating or receiving a desired electronic wave signal to propagate from or received by the receiver segment.

The transformer segment or layer similarly has a first face and an opposite second face. The first face of the transformer segment is formed adjacent to the second face of the transceiver or driver segment or section. The electronic wave signal from the driver segment propagates through the transformer segment from the first face of the transformer segment to the second face of the transformer segment from which second face of the transformer segment the electronic signal propagates into free space or other desired medium during transmission of the antenna and in an opposite direction during reception by the planar array. A plurality of free floating plates are formed or positioned within the transformer segment generally in layers with gaps between adjacent plates on a single layer to permit the passage of the electronic signal there through. The arrangement of the floating plates causes deflection in the path of the electronic signal as the electronic signal passes through the transformer segment from the first face of the transformer segment to the second face of the transformer segment and vice versa.

The present plates radiator is a novel implementation of a stepped impedance transformer that produces a resulting signal similar to a traditional stepped notch element. FIGS. 3 and 5 show a traditional stepped notch and the plates element of the present invention is generally shown in FIGS. 4 and 6. The tall metal sides on the stepped notch have been replaced with light-weight, compact, laminated foam and planar metal plates as is shown in FIGS. 4, 6, 7 and 8. The present invention results in a much shorter and lighter element or antenna array. Previously, metal blocks or metalized drums 62 (shown in FIG. 5) were often stacked together and used to form the transformer effects. Such metal blocks wasted both space or volume and height of the individual elements.

The plates element or layer of the present invention utilizes the same stepped impedance matching approach as a traditional stepped notch, but does so in a much more efficient manner. FIGS. 3 and 4 shows how the stepped impedance transforms are rotated and folded within the present plates element. Each impedance transform is implemented by properly spacing and sizing the planar metal plates. This rotation, folding, sizing and spacing allows the present plates element to realize the desired taper and meet the bandwidth requirements in much less volume.

These and other objects, advantages and preferred features of this invention will be apparent from the following description taken with reference to the accompanying drawings, wherein is shown the preferred embodiments of the invention.

BRIEF DESCRIPTION OF DRAWINGS

A more particular description of the invention briefly summarized above is available from the exemplary embodiments illustrated in the drawing and discussed in further detail below. Through this reference, it can be seen how the above cited features, as well as others that will become apparent, are obtained and can be understood in detail. The drawings nevertheless illustrate only typical, preferred embodiments of the invention and are not to be considered limiting of its scope as the invention may admit to other equally effective embodiments.

MODE(S) FOR CARRYING OUT THE INVENTION

Figure 1:
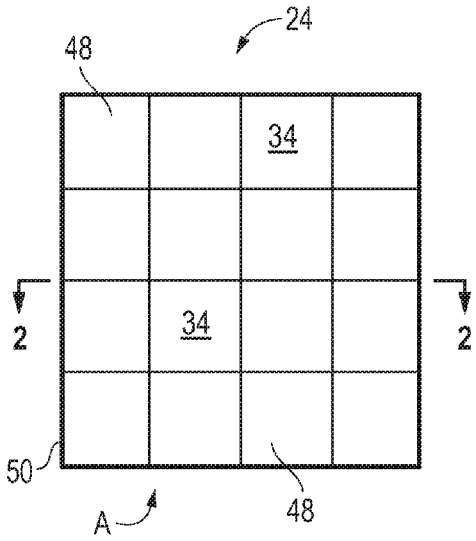
FIG. 1 is a top view of a planar array antenna.
Figure 2:
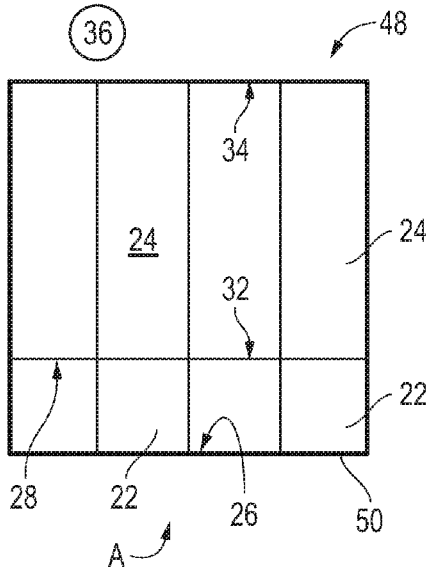
FIG. 2 is a side view of the planar array of FIG. 1 and is shown in cross-section along line 2-2 of FIG. 1.

So that the manner in which the above recited features, advantages and objects of the present invention are attained can be understood in detail, more particular description of the invention, briefly summarized above, may be had by reference to the embodiment thereof that is illustrated in the appended drawings. In all the drawings, identical numbers represent the same elements.

A radiator or planar antenna array A for conveying or receiving an electronic signal 20 of the type including at least one driver or transceiver segment or substrate 22 and an adjacent transformer to free space segment or section 24. The receiver or driver section 22 is generally formed having a first or lower side 26 and an opposite second or upper face or surface 28. The second side or face 28 further includes at least one point or source 30 for generating a desired electronic wave signal 20 to propagate from the driver segment 22, or for receiving a desired electronic wave signal 20 from the transformer or plates section or segment 24.

The folded transformer or plates segment or layer 24 similarly is formed having a first or lower face or surface 32 and an opposite second or upper surface or face 34. The first face 32 of the transformer segment 24 is formed adjacent to or on the second face 28 of the driver segment 22. The electronic wave signal 20 from the driver segment 22 propagates through the transformer segment 24 from the first face 32 of the transformer segment 24 to the second face 34 of the transformer segment 24 from which second face 34 of the transformer segment 24 the electronic signal 20 propagates into free space or other desired medium 36.

A plurality of free floating plates 38 are formed or positioned within the transformer segment 24 generally in layers 40 with gaps 42 between adjacent plates 38 on a single layer 40 to permit the passage of the electronic signal 20 there through. The arrangement of the floating plates 38 causes deflection in the path 44 (shown as a dotted line in FIGS. 4 and 6 for example) of the electronic signal 20 as the electronic signal 20 passes through the transformer segment 24 from the first face 32 of the transformer segment 24 to the second face 34 of the transformer segment 24. For reception of an electronic signal 20 from free space 36 the path of the electronic signal 20 is reversed through the transformer segment 24.

The known type of driver or transceiver segment or substrate 22 may also be known as or include a short circuit balun. An electronic signal 20 is produced from or emanates from a drive point 46 of the source 30 formed with the feed substrate 22. Such an alternative arrangement or embodiment of the transceiver section 22 may include a wave guide type element and a known signal generator or receiver (not shown). Such transceiver section 22 may be any size and arrangement that is consistent with the size and arrangement of the corresponding transformer section 24.

Alternatively, drive point 46 may be a receiver or a transceiver point from which or through which the electronic signal 20 is propagated or received. Such driver sections 22 are well known in the art.

Figure 6:
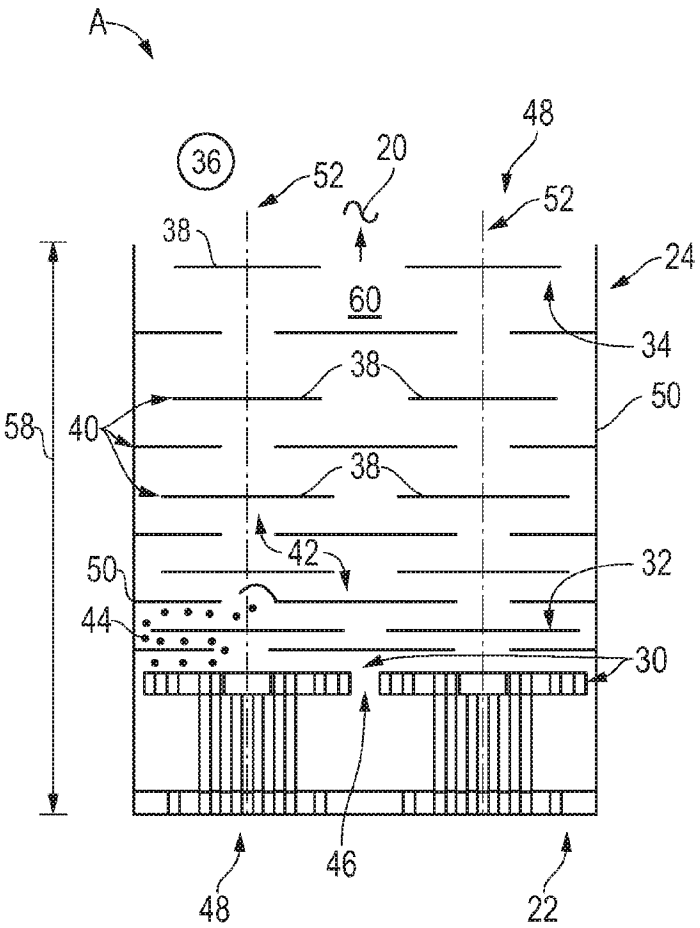
FIG. 6 is a cross-sectional side view of a plurality of transmission antenna elements of the present invention forming a portion of a planar antenna array.

A typical planar antenna array A is depicted in FIG. 1 and consists of a plurality of individual radiator elements or sections 48 formed or mated into a 4 element by 4 element array by way of example (any desired size or arrangement of an array may be utilized as selected). An outer jacket or absorber 50 may be formed with the outer, unmated surfaces of the outermost individual radiator elements or cell 48 in order to absorb or reflect the signal. The absorber 50 acts as a "wall" to the propagating wave 30 and is compatible with the action of two adjacent or mating individual radiating elements 48 as shown in FIG. 6 in which a virtual reflective wall or short is created between two adjacent individual radiating elements 48 that are being driven as is depicted by dashed lines 52 in that figure.

In the typical planar array, any particular or desired combination of individual radiating or receiving elements or cells 48 may be driven as desired to electronically steer the signal propagating from the array A into free space 36.

Also, there is a single drive point 46 corresponding to or in a typical radiator cell or section 48, although multiple drive points may be possible. For a single drive point 46 within a single radiator cell 48 arrangement, the drive point is normally centrally located within the upper surface 28 of the transceiver segment 22.

The transformer layer or section 24 of the present invention generally has the floating plates 38 forming folded transformers 56 suspended within a selected dielectric 60, such as a foam, a ceramic matrix, Teflon, or a Teflon glass as desired and dependent upon the choice of electronic characteristics necessary for signal matching.

Figure 3:
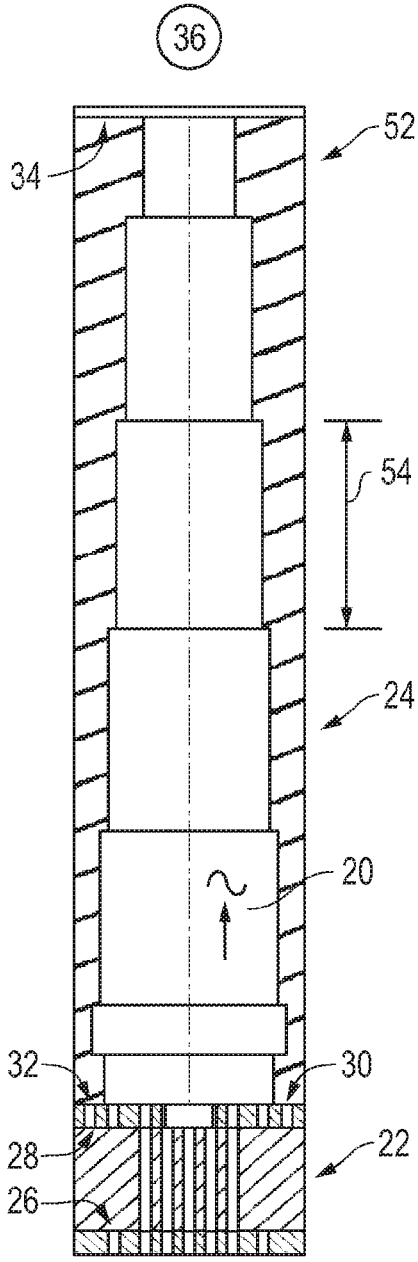
FIG. 3 (Prior Art)
FIG. 3 is a cross-sectional side view of a single transmission antenna element of a stepped notch type of the prior art.
Figure 4:
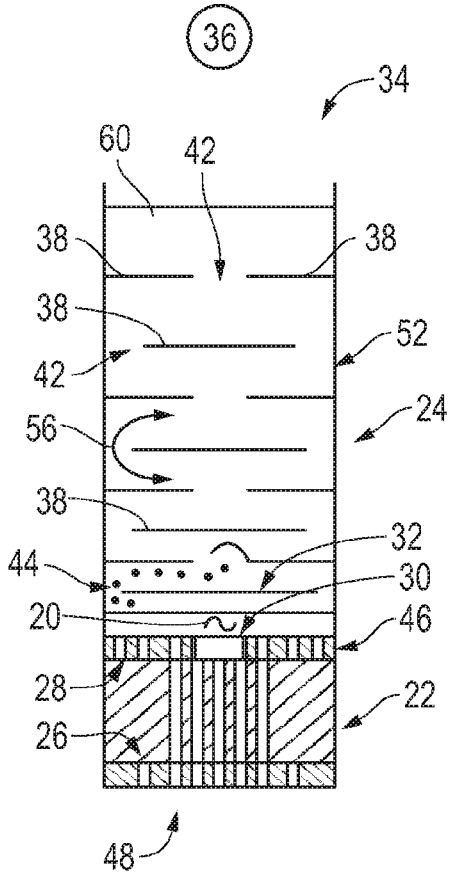
FIG. 4 is a cross-sectional side view of a single transmission antenna element of the present invention.
Figure 5:
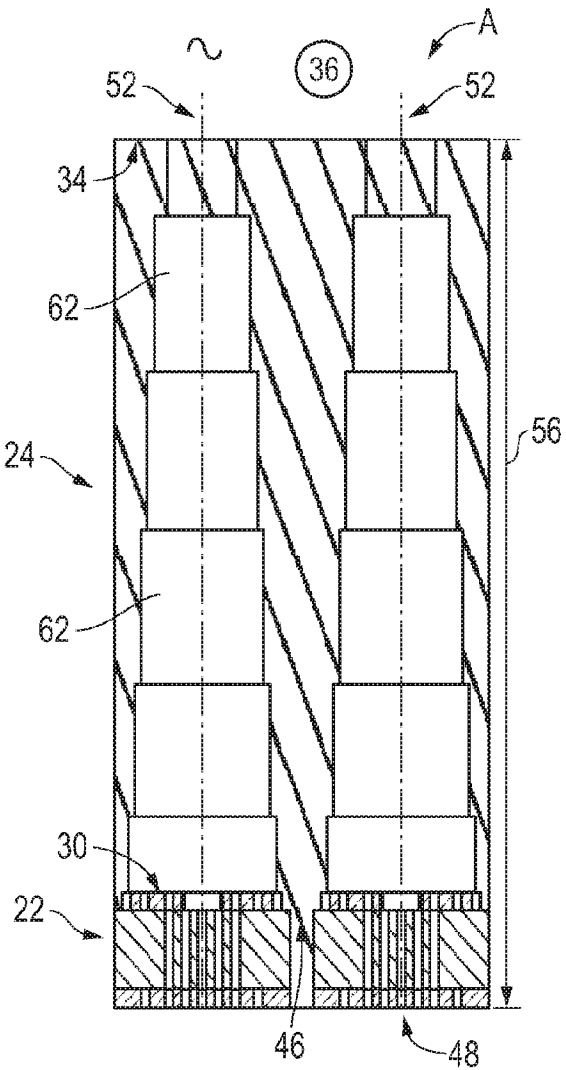
FIG. 5 is a cross-sectional side view of a plurality of transmission antenna elements of a stepped notch type of the prior art forming a portion of a planar antenna array.

The plates element 38 or layer 40 of the present invention utilizes the same stepped impedance matching approach as a traditional stepped notch, but does so in a much more efficient manner. FIGS. 3 and 4 shows how an individual level 54 in the stepped impedance transforms is rotated and folded 56 within the present plates element or cell 48. Each impedance transform is implemented by properly spacing and sizing the planar metal plates 38. This rotation, folding, sizing and spacing allows the present plates element or cell 48 to realize the desired taper and meet the bandwidth requirements in much less volume and a compression in height 56 of the known individual radiating element 48 (see FIG. 5) with regard to the height 58 of the individual radiating element 48 of the present invention (see FIG. 6).

Figure 8:
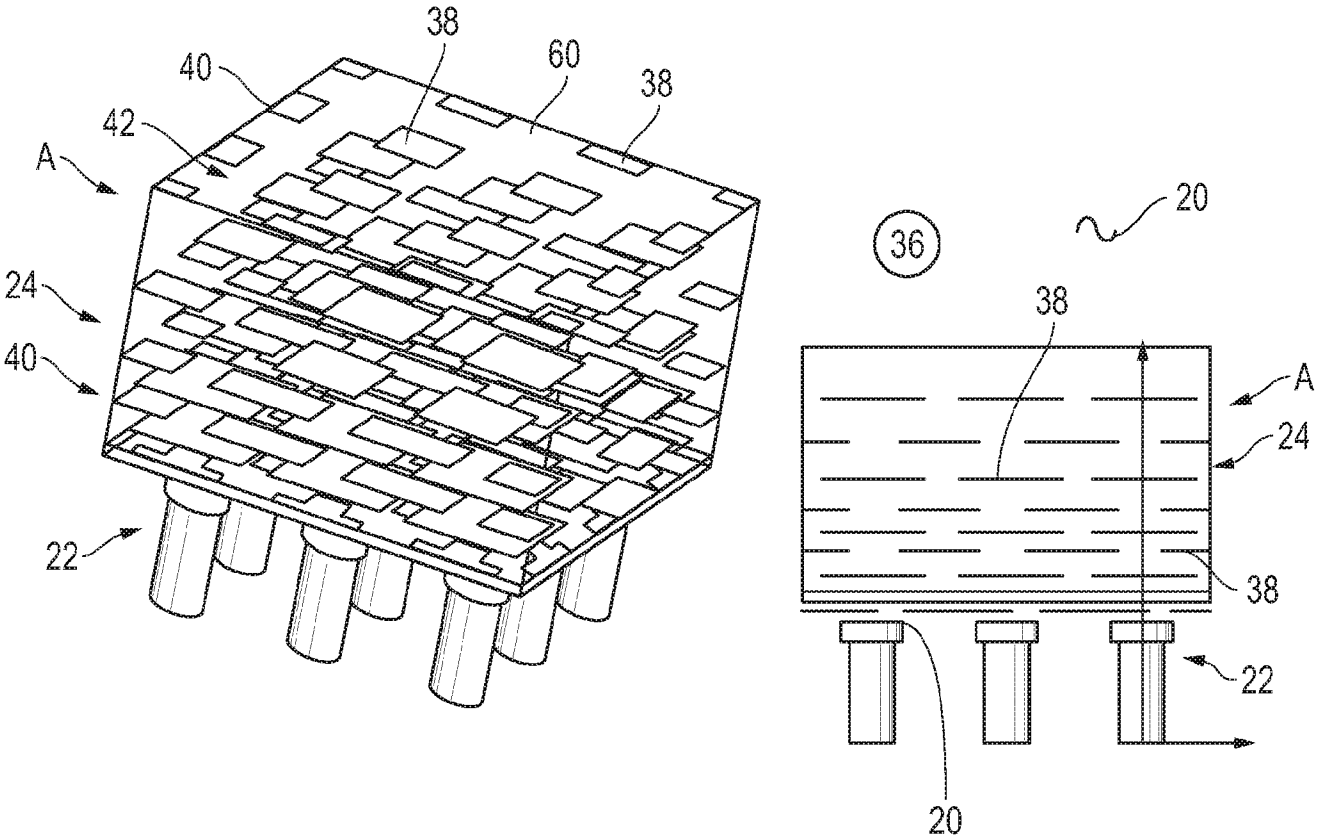
FIG. 8 is another isomeric view combined with a side view showing metal plates and laminated foam of one embodiment of the present invention.

FIGS. 4 and 6 of the present plates element are depicted as side views showing an element that would produce a single linear polarization. FIG. 8 on the other hand, shows how the arrangement of metal plates can be extended to realize dual polarization. FIG. 8 shows a three dimensional arrangement/stacking of the metal plates that supports two orthogonal polarizations as a consequence of rotating or shifting of the floating plates. This dual polarized version of the present plates element could be integrated with associated elements (transmission/receiver modules, phase shifters, etc.) in an electronically steerable array antenna (ESA) and support full polarimetric operations.

The dual polarized element may be modeled in an infinite array with element spacing set equal to ½-wavelength (square) at 5 GHz. An example of such modeling with the structure of the present invention shows that very wide impedance bandwidths (up to a decade or more) and large scan volumes (60 degrees so far) may be realized.

Figure 9:
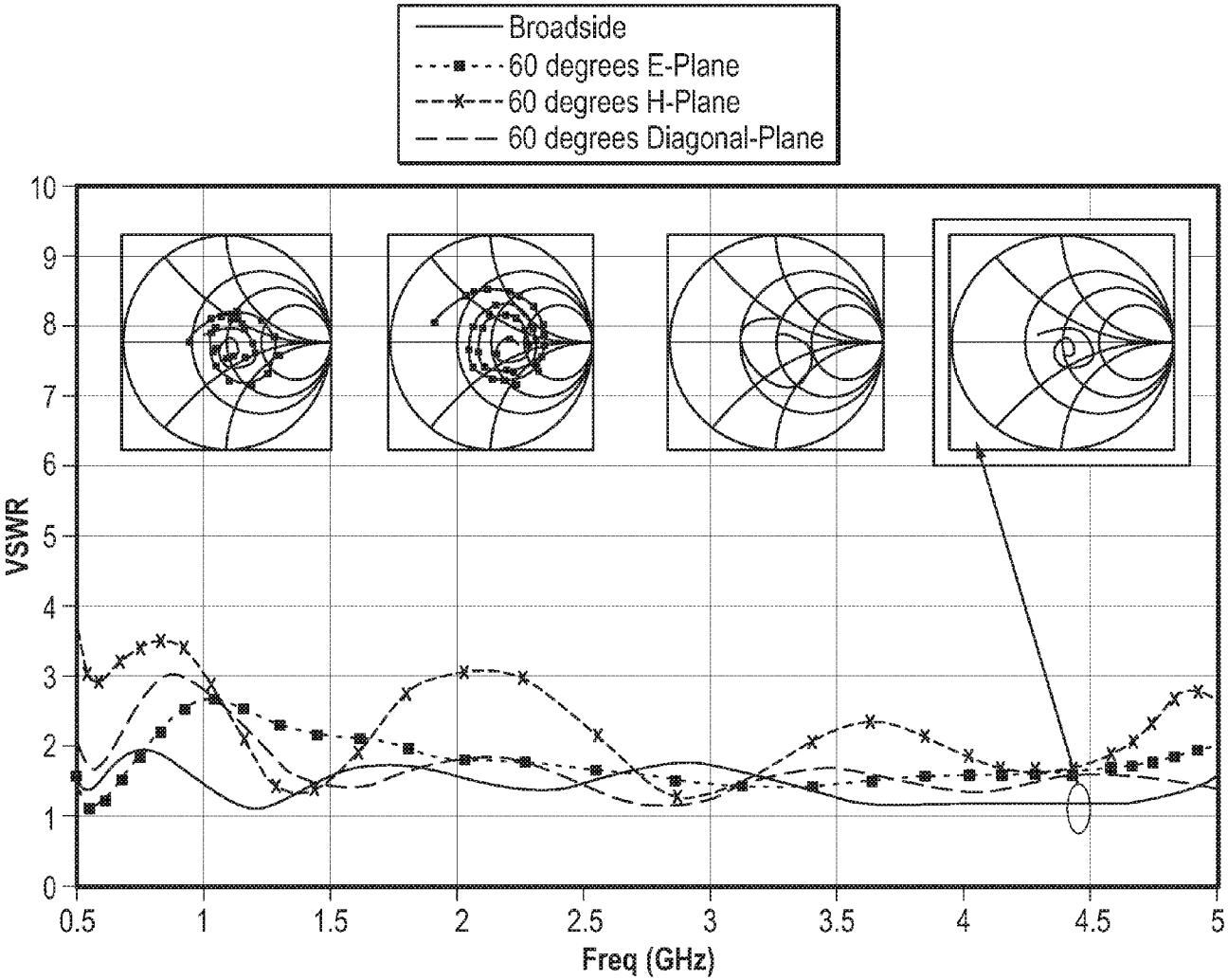
FIG. 9 is a combination of several plots showing the match for a dual polarized plates element (in an infinite array) of the present invention over 0.5 to 5 GHz at broadside and out to 60-degree scan.

Modeled results are shown in FIG. 9. The plot shows Voltage Standing Wave Ratio (VSWR) on the y-axis and frequency on the x-axis. The data is provided for broadside, E and H-plane (planes for linearly polarized antennas) scans at 60-degrees and an inter-cardinal cut at 60-degrees. A Smith Chart plot corresponding to each data set is also inserted into the Figure.

The broadside match shows an excellent result that is better than 2:1 over the entire band, with better than 1.5:1 over a good portion of the band. Most of the 60-degree scan cuts are better than 3:1 over the band, with the notable exception of the lower end of the H-plane scan. Some additional optimization may be done in that plane. However, overall the result shows the utility of the present invention. In particular, when one considers that the hypothetical case is a very challenging one—a very wide bandwidth over a wide scan volume.

The known transforming structures for wide band antennas are long, intricate and hard to make. In addition they are difficult to attach to the feed array. The present invention solves all of these problems and requires no electrical attachment to the feed. It can simply lay on top. It eliminates unused volume and weight and is shorter than the prior art.

The present invention is essentially a set of thin plates 38 of metal or other selected substances that, when placed at the appropriate locations above a set of feed or drive points 46 in an antenna array A, form a set of transformers to free space. Unlike known wideband stepped transformers, the present invention requires no electrical "connections" that need to be made. The plates 38 "float", and are easily supported by or within a light dielectric 60 such as honeycomb or foam or may be molded within a ceramic matrix.

This purpose of this invention is to drastically reduce the size, weight and cost of manufacturing existing transformer networks for wideband antennas while maintaining (and possibly improving) bandwidth and scan performance.

An interesting feature of wideband/wide scan arrays is that the element spacing and the transformer lengths from the feed point stepping out to free space tend to be a similar size. That is, just under ½ wavelength at the highest frequency in the band. This turns out to be a happy coincidence because one can use that feature to collapse the prior art's tall transformers down on to the array where they can be manufactured with a set of flat "floating" plates 38. This set of plates 38 of the present invention reduces overall height, removes the need to electrically attach the transformers, removes a lot of unwanted volume, and therefore weight. The plates 38 of the present invention and a planar array antenna A are also comparatively easier to construct using existing plating and etching technology. Electromagnetic modeling has been performed on a wideband aperture constructed using this method and shows that the present invention works very well.

A first embodiment of the present invention includes the element spacing and the transformer lengths (using a low dielectric foam) for typical wideband dual polarized arrays that are roughly the same dimension (just under ½ wavelength (λ) at the highest frequency of operation). One can use that fact to construct a "folded transformer" radiator using electrically floating flat plates 38 that are very thin and lightweight. While we specifically disclose a ½ wavelength (λ) separation, other desired separations lengths may be used as a matter of design.

Figure 7:
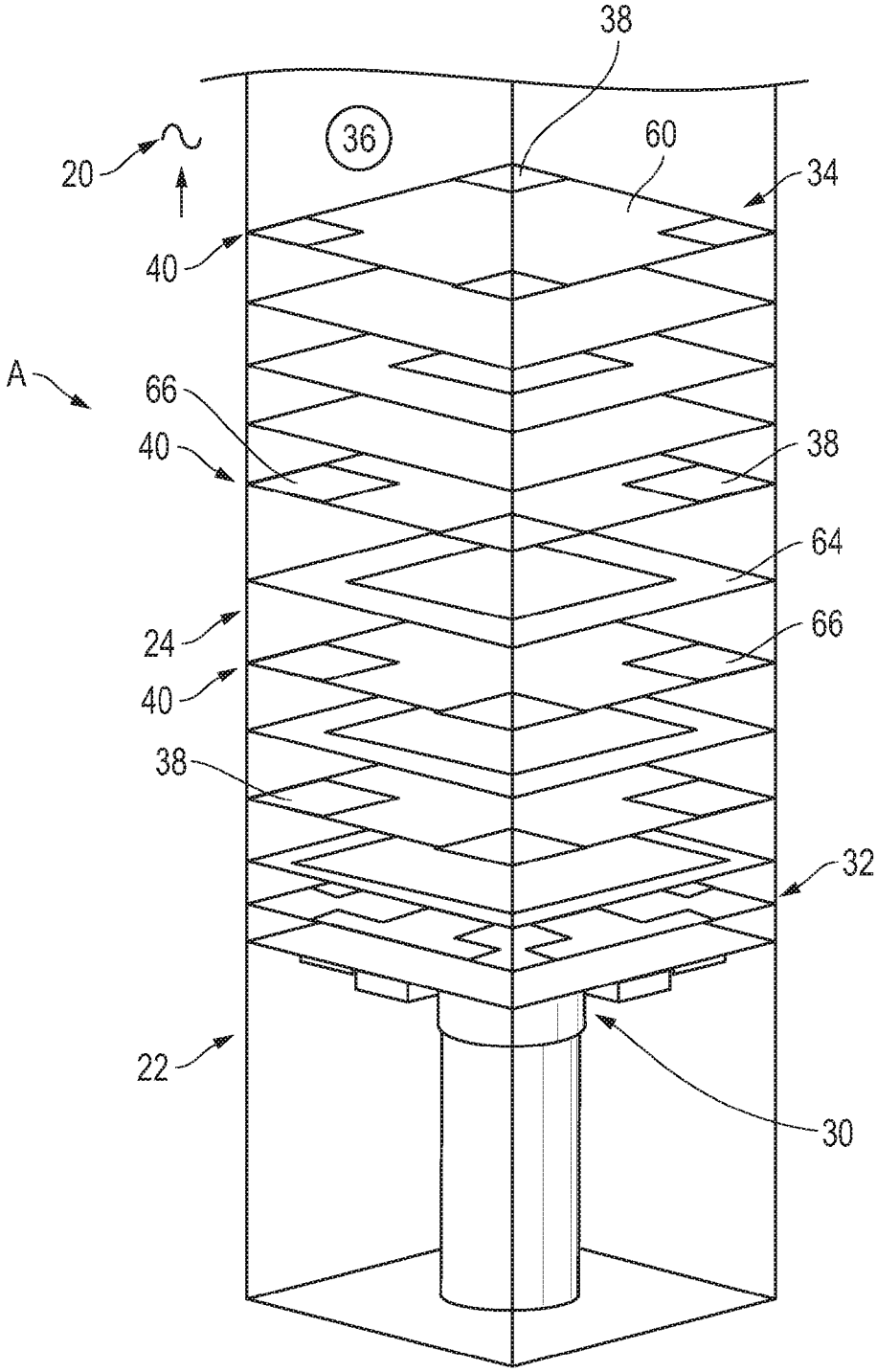
FIG. 7 is an isomeric view showing metal plates and laminated foam for the present invention.

Alternative embodiments of the present invention may have more than one floating plate equivalent per layer 40 corresponding to a single cell or element 48. One floating plate equivalent is considered by way of example to be a full floating plate 38 per layer 40 in each cell 48 of the planar array A, or may be composed of two floating plate halves 66 in which a single floating plate 38 is shared between two adjacent cells 48 as is shown in FIG. 7 and others.

While the accompanying figures depict the floating plates 38 in a square shape, other shapes, such as triangular, rectangular, etc., may be chosen as a matter of design an may correspond to the shape of the grid arrangement of drive points 46 in the planar array A. The composition of the floating plates 38, such as copper or other metals, along with the thickness of the floating plate 38, the spacing or size of the gaps 42 between adjacent floating plates 38, and the distance between successive layers 40 may all affect the performance characteristics of the transformer segments 24 and the resulting planar array A.

Further, additional or alternative embodiments of the present invention may include the following features or elements:

- Can be tuned to a wide variety of dielectrics not just low dielectrics.
- Plate spacing and gaps can be widely varied (no longer tied to the element spacing).
- A Triangular grid of drive points 46 has been found to work and may be used rather than a checkerboard pattern. Other grid arrangements or shapes, such as rectangular, hexagonal, etc., may be chosen as a matter of design.
- Floating plate features can be so small that they can be analyzed as artificial dielectrics.
- A carrier 64 (FIG. 7) composed of a Mylar sheet or other compatible materials may be used to support one or more plates 38 within the dielectric 60 matrix.

The foregoing disclosure and description of the invention are illustrative and explanatory thereof, and various changes in the size, shape and materials, as well as in the details of the illustrated construction may be made without departing from the spirit of the invention.

The invention claimed is:

1. A radiator for conveying an electronic signal of the type including a driver segment and an adjacent transformer to free space segment, the improvement comprising:

the driver segment having a first face and an opposite second face; the second face further including a source for processing a desired electronic wave signal; and, the transformer segment having a first face and an opposite second face; the first face of the transformer segment being adjacent to the second face of the driver segment; an electronic wave signal propagates through the transformer segment from the first face of the transformer segment to the second face of the transformer segment from which second face of the transformer segment the electronic signal propagates into free space or other desired medium for signal transmission and in an opposite direction for signal reception of an electronic wave signal; a plurality of free floating plates positioned within the transformer segment causes deflection in the path of the electronic signal as the electronic signal passes through the transformer segment between the first face of the transformer segment and the second face of the transformer segment.

2. The invention of claim 1 wherein a selected dielectric material occupies the interstitial area of the transformer segment between the floating plates.

3. The invention of claim 1 wherein impedance of the transformer segment increases through the transformer segment from the first face to the second face.

4. The invention of claim 1 wherein the free floating plates are formed within a desired dielectric material.

5. The invention of claim 1 wherein the free floating plates are suspended within a desired dielectric material on a sheet of Mylar or compatible material.

6. The invention of claim 1 wherein the driver segment transmits an electronic signal.

7. The invention of claim 1 wherein the driver segment receives an electronic signal.

8. A method for constructing a radiator for conveying an electronic signal of the type including a driver segment and an adjacent transformer to free space segment, the improvement comprising:

forming the driver segment having a first face and an opposite second face; the second face further including a source for processing a desired electronic wave signal; and, forming the transformer segment adjacent to the driver segment; the transformer segment having a first face and an opposite second face; the first face of the transformer segment being adjacent to the second face of the driver segment; an electronic wave signal propagates through the transformer segment from the first face of the transformer segment to the second face of the transformer segment from which second face of the transformer segment the electronic signal propagates into free space or other desired medium for signal transmission and in an opposite direction for signal reception of an electronic wave signal; a plurality of free floating plates positioned within the transformer segment causes deflection in the path of the electronic signal as the electronic signal passes through the transformer segment between the first face of the transformer segment and the second face of the transformer segment.

9. The method of claim 8 wherein the transformer segment is formed with a selected dielectric material occupies the interstitial area of the transformer segment between the floating plates.

10. The method of claim 8 wherein impedance of the transformer segment increases through the transformer segment from the first face to the second face.

11. The method of claim 8 wherein the free floating plates are formed within a desired dielectric material.

12. The method of claim 8 wherein the free floating plates are suspended within a desired dielectric material on a sheet of Mylar or compatible material.

13. The method of claim 8 wherein the driver segment transmits an electronic signal.

14. The method of claim 8 wherein the driver segment receives an electronic signal.

* * * * *